US006354005B1

(12) United States Patent
Bosch

(10) Patent No.: US 6,354,005 B1
(45) Date of Patent: Mar. 12, 2002

(54) SHAVING APPARATUS

(75) Inventor: Sieds Bosch, Drachten (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/469,878

(22) Filed: Dec. 22, 1999

(30) Foreign Application Priority Data

Dec. 29, 1998 (EP) ..... 98204476

(51) Int. Cl.[7] ..... B26B 19/14
(52) U.S. Cl. ..... 30/43.6; 30/41.6
(58) Field of Search ..... 30/43, 43.4, 43.5, 30/43.6, 41.6, 41

(56) References Cited

U.S. PATENT DOCUMENTS

| | | | | | |
|---|---|---|---|---|---|
| 2,952,909 | A | * | 9/1960 | Vaes | 30/43.6 |
| 3,032,873 | A | | 5/1962 | Vaes | 30/43 |
| 3,078,570 | A | * | 2/1963 | Vaes | 30/41.6 |
| 3,281,936 | A | * | 11/1966 | de Haan et al. | 30/41.6 |
| 4,318,223 | A | * | 3/1982 | Bergsma et al. | 30/43.6 |
| 4,442,597 | A | * | 4/1984 | Bergsma et al. | 30/43.6 |
| 5,111,580 | A | * | 5/1992 | Bosscha et al. | 30/41.6 |
| 6,131,288 | A | * | 10/2000 | Westerhof et al. | 30/41 |

OTHER PUBLICATIONS

"New Norelco Speedshaver", Look Magazine, Apr. 15, 1958, p. 8.*

* cited by examiner

*Primary Examiner*—Hwei-Siu Payer
(74) *Attorney, Agent, or Firm*—Ernestine C. Bartlett; Norman N. Spain

(57) ABSTRACT

A shaving apparatus has a housing (1), a shaving head (2) and a hair-collecting chamber (3) for collecting hair cuttings, the shaving head comprising a holder (4) which is connected to the housing by means of a hinge construction (15). The holder comprises an external cutting member (6) and an internal cutting member (8). For driving the internal cutting member a drive member (11) of a drive unit (10) can be coupled to the internal cutting member (8). For cleaning the hair-collecting chamber (3) the chamber is opened by pivoting the holder (4) and after the cleaning process the holder is pivoted back onto the housing. During opening and closing of the hair-collecting chamber the drive member (11) and the internal cutting member (8) are coupled and uncoupled. In order to improve coupling and uncoupling the hinge construction is such that in a first stage of the movement of the holder the holder is moved substantially in a longitudinal direction (14) of the drive member (11).

9 Claims, 5 Drawing Sheets

SHAVING APPARATUS

BACKGROUND OF THE INVENTION

The invention relates to a shaving apparatus having a housing and a shaving head, a hair-collecting chamber for collecting hair cuttings being situated between the housing and the shaving head, which shaving head has a holder which holds at least one shaving unit comprising an external cutting member and a drivable internal cutting member which cooperates with said external cutting member, which shaving apparatus has a drive unit including a drive member having a longitudinal direction, which internal cutting member has been provided with a coupling element adapted to be coupled to the drive member, and which holder is connected to the housing by means of a hinge construction.

The afore-mentioned shaving apparatus is known from U.S. Pat. No. 3,032,873. Such a shaving apparatus is to be cleaned at regular intervals. For this purpose, the hair-collecting chamber is opened by pivoting the holder away from the housing. After cleaning the holder is pivoted back onto the housing, upon which the internal cutting member should again be coupled to the drive member. The coupling element of the internal cutting member is formed by a coupling aperture which is engageable over the drive member. Coupling is not a problem as long as the pivotal axis of the hinge construction is situated at a comparatively small distance from the plane in which coupling is effected. However, in practice this distance is such that the internal cutting member may not be coupled correctly to the drive member because the internal cutting member is then moved towards the drive member in a position which is inclined too much and, as a result of this, the coupling aperture of the internal cutting member does not engage over the drive member but assumes a position slightly offset from this drive member.

SUMMARY OF THE INVENTION

It is an object of the invention to achieve that uncoupling and coupling of the drive member and the coupling element of the internal cutting member in a shaving apparatus proceed faultlessly.

To achieve this object the invention is characterized in that the hinge construction is such that during opening of the hair-collecting chamber, in a first stage, the holder performs a movement with respect to the housing, which movement is oriented substantially in the longitudinal direction of the drive member and is directed away from the housing. Uncoupling as well as coupling of the internal cutting member and the drive member is effected during said first stage of the movement of the holder with respect to the housing. In this first stage the movement of the holder with respect to the housing is now substantially rectilinear, as a result of which the coupling element of the internal cutting member moves away from or towards the drive member with a substantially rectilinear movement rather than with a comparatively short pivotal movement, as in the known shaving apparatus. This automatically provides a correct coupling.

The movement in the first stage is substantially in the longitudinal direction of the drive member. "Substantially" is to be understood to mean that the movement need not be a purely rectilinear movement but may alternatively be, for example, a rotary movement with a comparatively large radius of curvature. The movement with a comparatively large radius of curvature is a close enough approximation to a rectilinear movement to guarantee a correct coupling.

Preferably, such a shaving apparatus is characterized in that, for opening the hair-collecting chamber, the holder performs a pivotal movement with a comparatively small radius of curvature with respect to the housing in a second stage following the first stage. This enables the hinge construction to be comparatively simple and compact.

For the purpose of cleaning it is desirable that the holder remains in a certain open position. For this purpose a further embodiment comprises locking means for locking the holder against pivotal movement at the end of the second stage.

It is also desirable that the holder can be removed completely from the housing. For this purpose the holder performs a further pivotal movement, during which the holder is unlocked from the housing, in a third stage following the second stage.

A preferably used embodiment is characterized in that the hinge construction has an arcuate limb and an arcuate guide which cooperates with said limb, which limb has a first limb portion having a comparatively large radius of curvature and, adjoining the first limb portion, a second limb portion having a comparatively small radius of curvature, and which guide is formed by walls of the guide projections, at least one first wall having a comparatively large radius of curvature for cooperation with the first limb portion and at least one second wall having a comparatively small radius of curvature for cooperation with the second limb portion. Viewed from the position in which the holder is mounted on the housing and the hair-collecting chamber is to be opened, the holder is first pivoted over a comparatively large radius of curvature, during which the internal cutting member is disengaged from the drive member and is subsequently pivoted over a comparatively small radius of curvature in order to open the hair-collecting chamber completely.

In a further embodiment the locking means are formed by a projecting portion at the free end of the second limb portion and, cooperating therewith, a recess of the guide projection.

A further embodiment is characterized in that two identical hinge constructions have been provided, which hinge constructions are spaced at a distance from one another and are arranged symmetrically with respect to one another, the holder having two supports which are spaced at said distance from one another and which each carry the arcuate guide comprising the guide projections, the supports being moved in a direction transverse to the pivoting direction of the holder in the third stage, the guide projections sliding over the arcuate limbs.

To replace the holder onto the housing it is favorable if he holder has been provided with two guide limbs which are disposed opposite one another for cooperation with corresponding recesses of the housing. The holder can then be slid into the recesses with its guide supports and can subsequently be attached to the housing with a substantially straight movement, i.e. nearly without a pivotal movement. The parts of the hinge construction then automatically assume the correct positions. Moreover, the guide supports may be provided with latching means for latching the holder to the housing.

Yet another embodiment is characterized in that the housing has a chamber adapted to hold an additive container, which container has an outlet for an additive, which shaving apparatus further comprises a pump having an inlet, which can be connected to the outlet of the additive container, and having an outlet opening, which holder has a dispenser channel having an inlet opening to which the outlet opening of the pump can be connected and through which the additive can be dispensed by means of the pump, the dispenser channel having a longitudinal direction which is oriented parallel to the longitudinal direction of the drive member. Since the direction of movement of the holder in the first stage is oriented substantially parallel to the dispenser channel this automatically results in a correct connection as well as a correct disengagement of the connection between the outlet opening of the pump and the inlet opening of the dispenser channel. This provides a proper connection which is free from leakage. A shaving apparatus having an additive dispenser is already known per se by the name of Philishave "Cool Skin", type number HQ 5620, available from Philips since the spring of 1998. By means of this shaving apparatus an additive is applied to the skin during shaving, as a result of which an improved shaving performance is obtained. It is very important that the hair-collecting chamber and the shaving unit or shaving units of such a shaving apparatus are rinsed with moderately warm water at regular intervals, preferably immediately after use.

BRIEF DESCRIPTION OF THE DRAWINGS

The invention will now be described in more detail with reference to an example shown in the drawings. In the drawings

DESCRIPTION OF THE PREFERRED EMBODIMENTS

Figure 1:
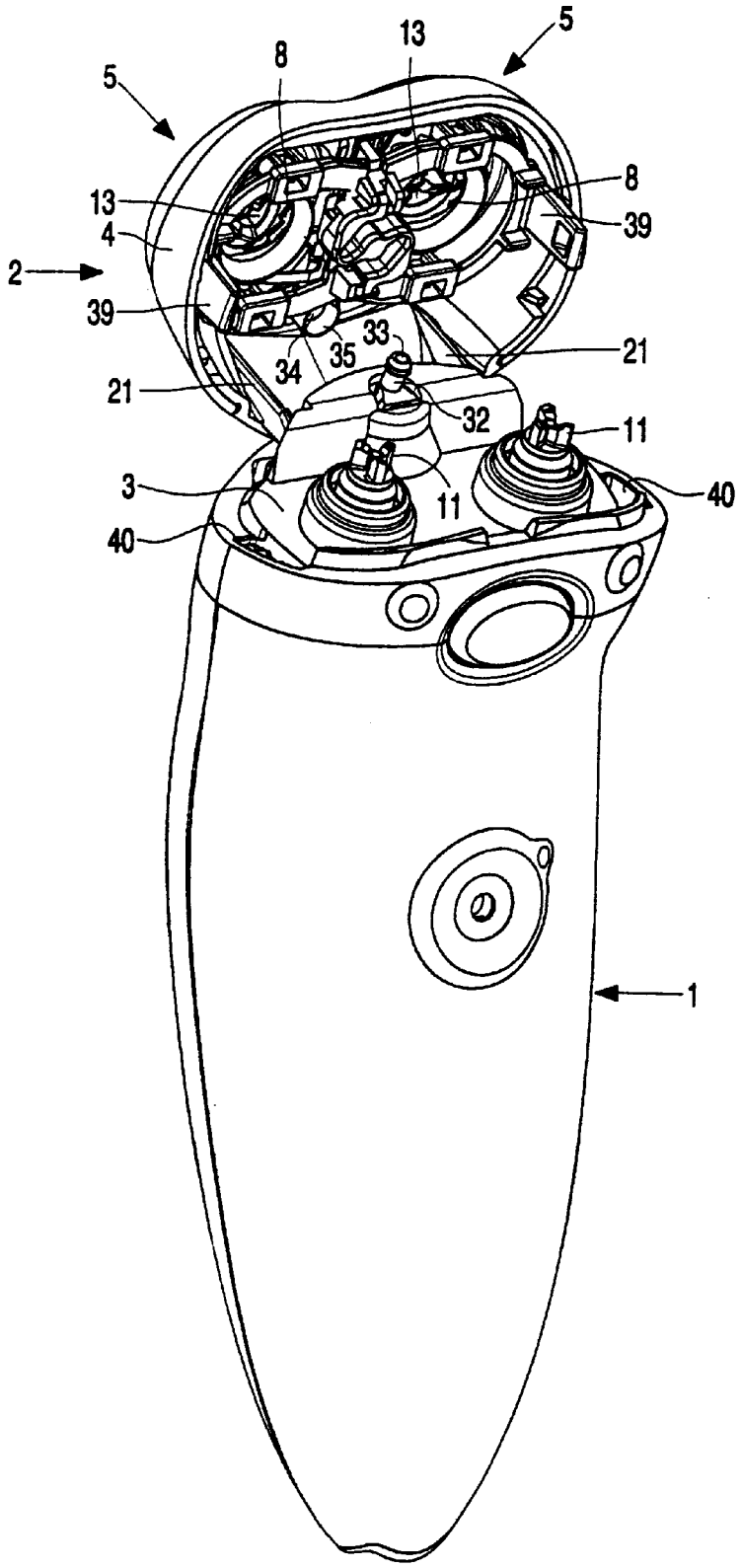
FIG. 1 is a perspective view of a twin-head shaving apparatus.

FIG. 1 shows an electrically driven twin-head shaving apparatus having a housing 1, a shaving head 2 and a hair-collecting chamber 3, which is interposed between the shaving head and the housing. The shaving head has a holder 4, which holds two shaving units 5. Each shaving head has an external cutting member 6 in the form of a cap having a plurality of hair entry apertures 7. A drivable internal cutting member 8, which has a plurality of cutting elements 9, cooperates with the external cutting member 6. Hairs which enter the hair entry apertures 7 are severed by the cutting elements 9. The hair cuttings are collected in the hair-collecting chamber 3, which should be cleaned at regular intervals. The internal cutting member and the external cutting member are not readily visible in FIG. 1. These parts are better visible in the diagrammatic representation in FIG. 2.

Figure 2:
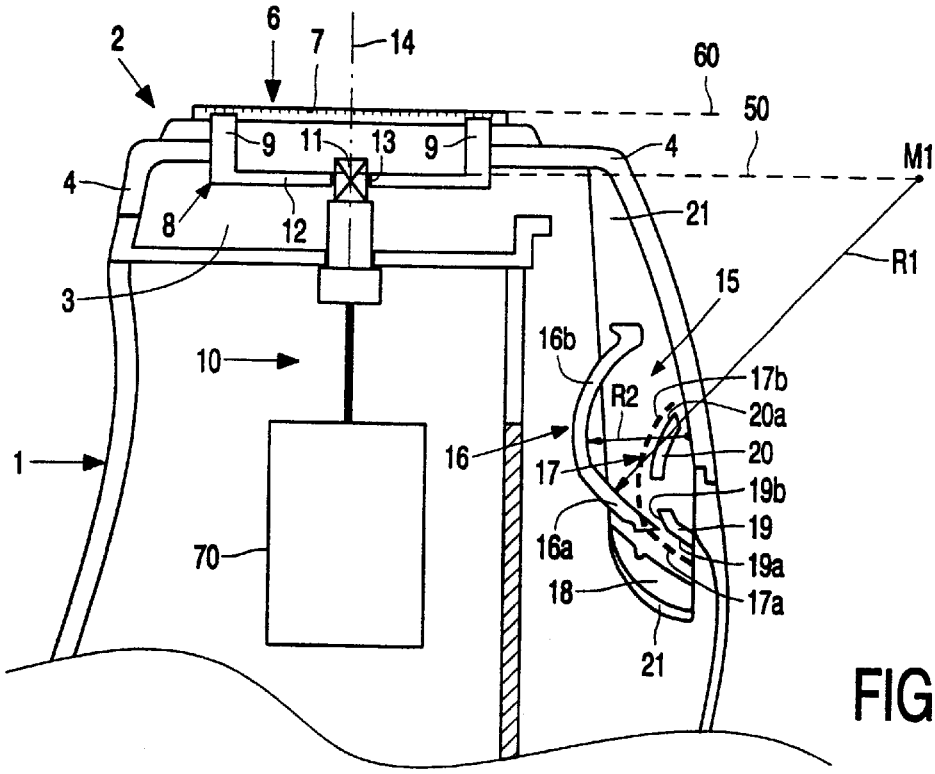
FIG. 2 is a diagrammatic cross-sectional view of a part of the shaving apparatus shown in FIG. 1.

FIG. 2 shows only the upper part of the shaving apparatus. The housing 1 accommodates a drive unit 10 including a motor 70 and a drive member 11. The internal cutting member 8 has a disc-shaped basic portion 12 carrying a plurality of cutting elements 9 at its periphery. The internal cutting member has a coupling element 13 in the form of a central aperture formed in the basic portion. For driving the internal cutting member the coupling element 13 is coupled to the drive member 11. For this purpose, the drive member 11 engages the coupling aperture 13. For the sake of simplicity, the aperture 13 and the drive member 11 are shown as a square. The drive member can thus rotationally drive the internal cutting member. The drive member 11 has a longitudinal direction represented as a line 14.

The holder 4 is connected to the housing 1 by means of a hinge construction 15. The hinge construction is formed by an arcuate limb 16 secured to the housing 1 and an arcuate guide 17 mounted on the holder 4 and represented as a dashed line. The arcuate limb 16 has a first limb portion **16*a* having a comparatively large radius of curvature (R1) whose center is M1 and, adjoining this first limb portion, a second limb portion 16*b* having a comparatively small radius of curvature (R2) whose center is M2. The guide 17 is situated between guide projections 18, 19 and 20. These guide projections are carried by a support 21 of the holder 4. The guide walls which can move along the arcuate limb 16 are formed by first walls 18*a* and 19*a* of the respective guide projections 18 and 19, which first walls have a comparatively large radius of curvature (center M1) for cooperation with the first limb portion 16*a*, and by second walls 19*b* and 20*a* of the respective guide projections 19 and 20, which second walls have a comparatively small radius of curvature (center M2) for cooperation with the second limb portion 16*b*. Preferably, two hinge constructions are used. For this purpose, two spaced-apart identical hinge constructions 15 are arranged symmetrically with respect to one another. See FIG. 1**.

Figure 3:
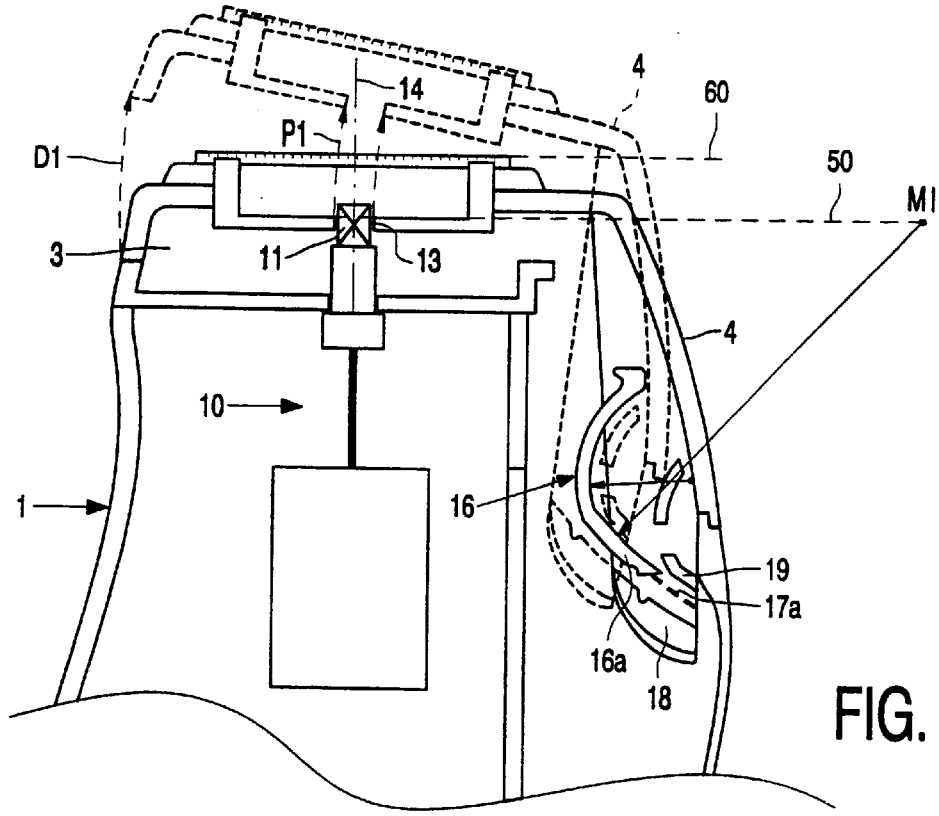
FIG. 3 is a diagrammatic cross-sectional view of the shaving apparatus, similar to that of FIG. 2, the shaving head being shown in dashed lines in a first position.

To open the hair-collecting chamber 3 (see FIG. 3) the holder 4 is pivoted with respect to the housing 1. In a first stage of the pivotal movement the first portion **17*a* of the guide 17 moves along the first limb portion 16*a* having a comparatively large radius of curvature with the center M1. The position of the holder at the end of the first stage is represented as a dashed line. The best situation is obtained when in the first stage the holder is pivoted about a point situated in the proximity of a coupling plane 50 in which the drive member 11 is disposed and which is parallel to the shaving plane 60. The movement of the coupling aperture 13 in this first stage is indicated by arrows P1. These arrows indicate that the movement is oriented in the longitudinal direction 14 of the drive member 11. This means that the coupling aperture 13 moves away from the drive member with a substantially rectilinear movement. This happens not only during opening of the hair-collecting chamber 3** but also during closure of the hair-collecting chamber, when the holder is replaced on the housing and the internal cutting member should again be coupled to the drive member.

Figure 4:
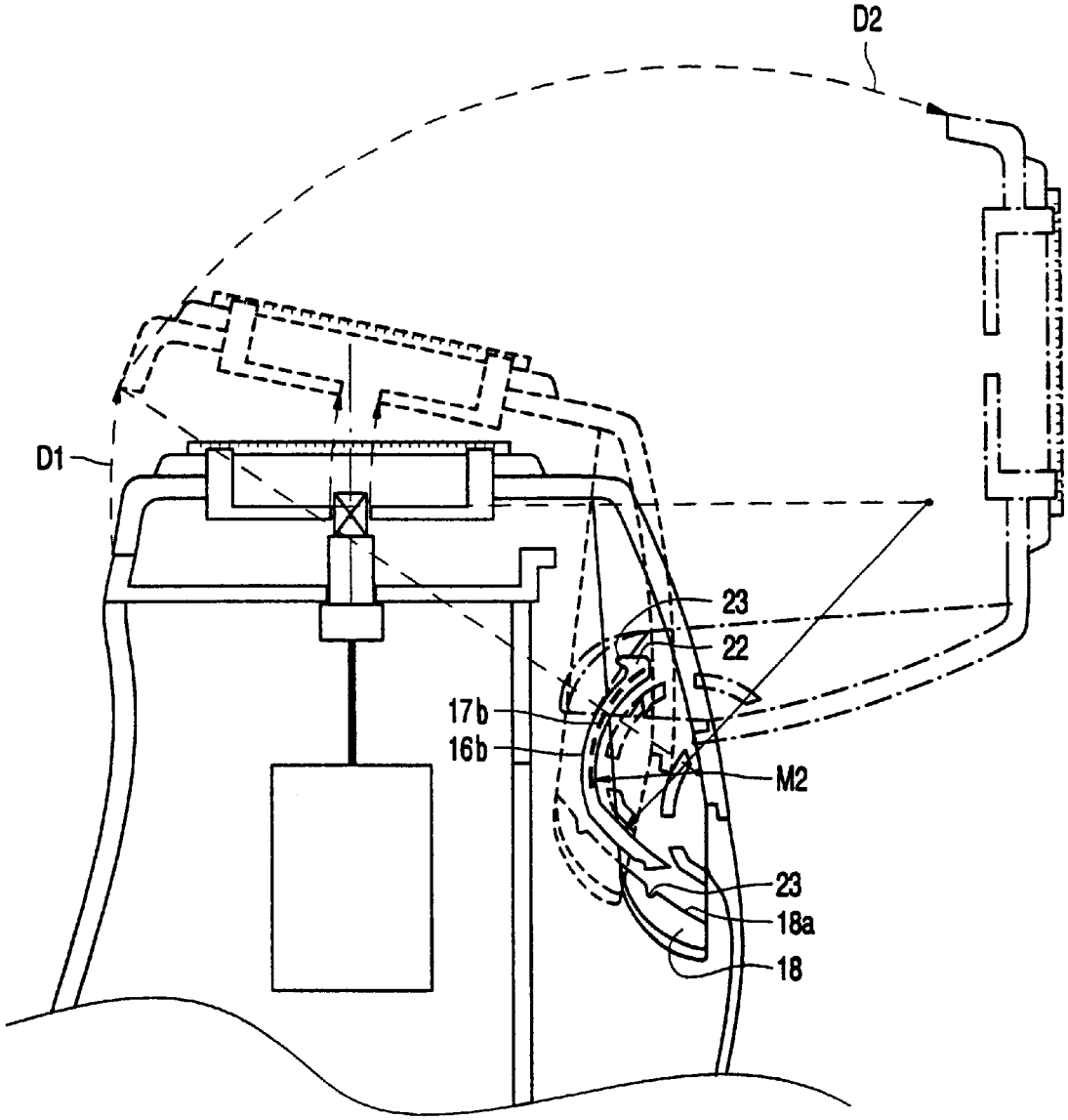
FIG. 4 is a diagrammatic cross-sectional view of the shaving apparatus, similar to that of FIG. 3, the shaving head also being shown in dash-dot lines in a fully open second position.

To open the hair-collecting chamber further (see FIG. 4) the second portion **17*b* of the guide 17 of the holder is pivoted along the second limb portion 16*b* of the housing having a comparatively small radius of curvature with the center M2, which is effected in a second stage (D2) following the first stage (D1). The position of the holder at the end of the second stage is represented as a dash-dot line. The free end of the second limb portion 16*b* carries a projecting portion 22. At the end of the second stage this projecting portion engages against the wall 18*a* of the guide projection 18 and, as the pivotal movement of the holder proceeds, it experiences a friction which resists further pivotal movement of the holder. The guide projection 18 may have a recess 23 for cooperation with the projecting portion 22. In the open position the projecting portion snaps into the recess, as a result of which the holder is locked in this position. In this position of the holder the hair-collecting chamber 3, the inside and the outside of the holder 4 with the internal cutting member and the external cutting member can be cleaned, for example by rinsing with lukewarm water under the tap. By pivoting the holder even further with some force (in a third stage, not indicated) the projecting portion is pulled out of the recess and can slide along the wall 18***a* with some resistance until the projecting portion has moved wholly past the guide projection 18 out of the guide and can be removed from the housing.

Figure 5:
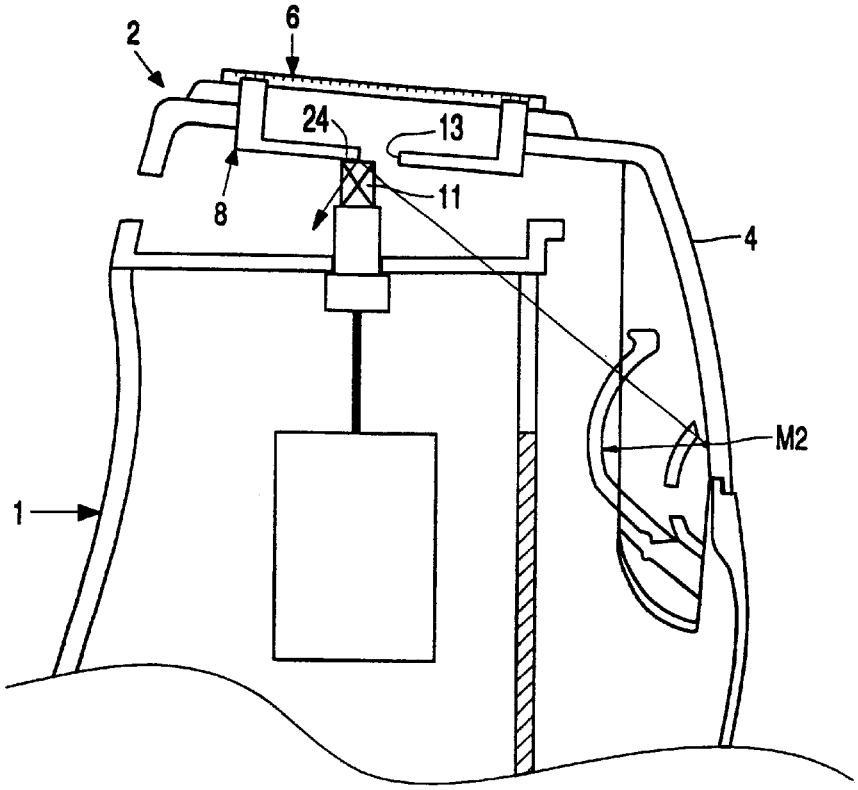
FIG. 5 is a diagrammatic cross-sectional view similar to that of FIG. 2, showing the shaving apparatus in a situation in which the holder cannot be swung properly onto the housing.

FIG. 5 illustrates a situation in the case that the holder would also be pivoted about the center M2 in the first stage. As can be seen, the edge 24 of the coupling aperture 13 then abuts against the drive member 11, thereby preventing a correct coupling.

Figure 6:
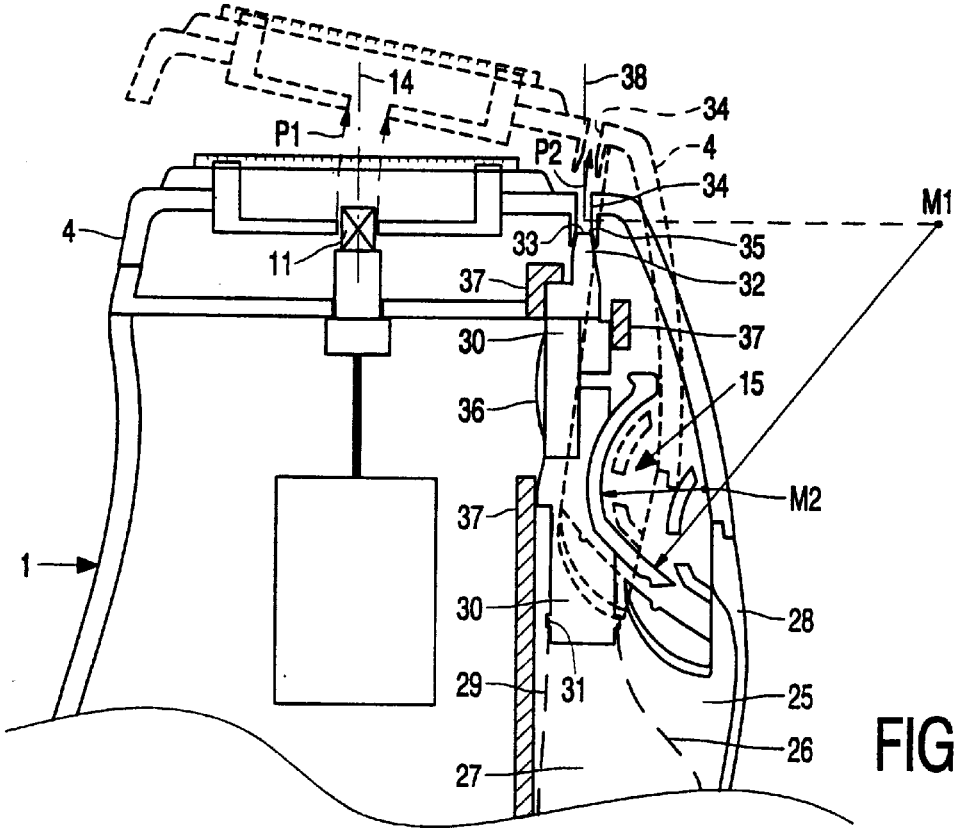
FIG. 6 is a diagrammatic cross-sectional view of the shaving apparatus, similar to that of FIG. 3, the shaving apparatus having an additive container.

In the shaving apparatus shown in FIG. 6 the housing has a chamber 25 which can accommodate an additive container 26. This container contains an additive 27, such as a shaving balsam, which can be applied to the skin. The housing has a detachable wall portion 28 to allow an additive container 26 to be placed into the chamber 25 of the housing. A pump 30 is connected to the outlet 29 of the container. The pump has an inlet 31 connected to the outlet 29 of the container and has an outlet in the form of a tubular portion 32 with an outlet opening 33 at its end. The holder 4 has a dispenser channel 34 for the additive 27. An inlet opening 35 of the dispenser channel can be connected to the tubular outlet portion 32 of the pump 30. The tubular portion is then situated partly in the dispenser channel and is slightly tapered in order to obtain a better sealing. The diaphragm 36 of the pump 30 can be actuated by means of a mechanism, not shown, as a result of which the additive 27 is applied to the skin via the dispenser channel 34. To place the additive container 26 into the chamber 25, the wall portion 28 is detached and the container 26 with the pump 30 mounted on it is slid into the chamber between the wall portions 37 of the housing.

The movement of the dispenser channel 34 during this first stage is indicated by the arrow P2. This arrow shows that this movement is oriented substantially in the longitudinal direction 38 of the dispenser channel 34 and, consequently, substantially parallel to the longitudinal direction 14 of the drive member 11. This means that the inlet opening 35 of the dispenser channel is moved away from the tubular outlet portion 32 of the pump in the longitudinal direction of the dispenser channel with a substantially rectilinear movement. This happens not only during opening of the hair-collecting chamber but, in particular, also during closure of the hair-collecting chamber, when the holder is pivoted back onto the housing. The inlet opening 35 of the dispenser channel then precisely engages the tubular outlet portion 34 of the pump, as a result of which a proper connection is obtained. Therefore, the hinge construction 15 is also favorable in order to obtain a correct connection between the outlet opening 33 of the pump 30 and the inlet opening 35 of the dispenser channel 34.

Figure 7:
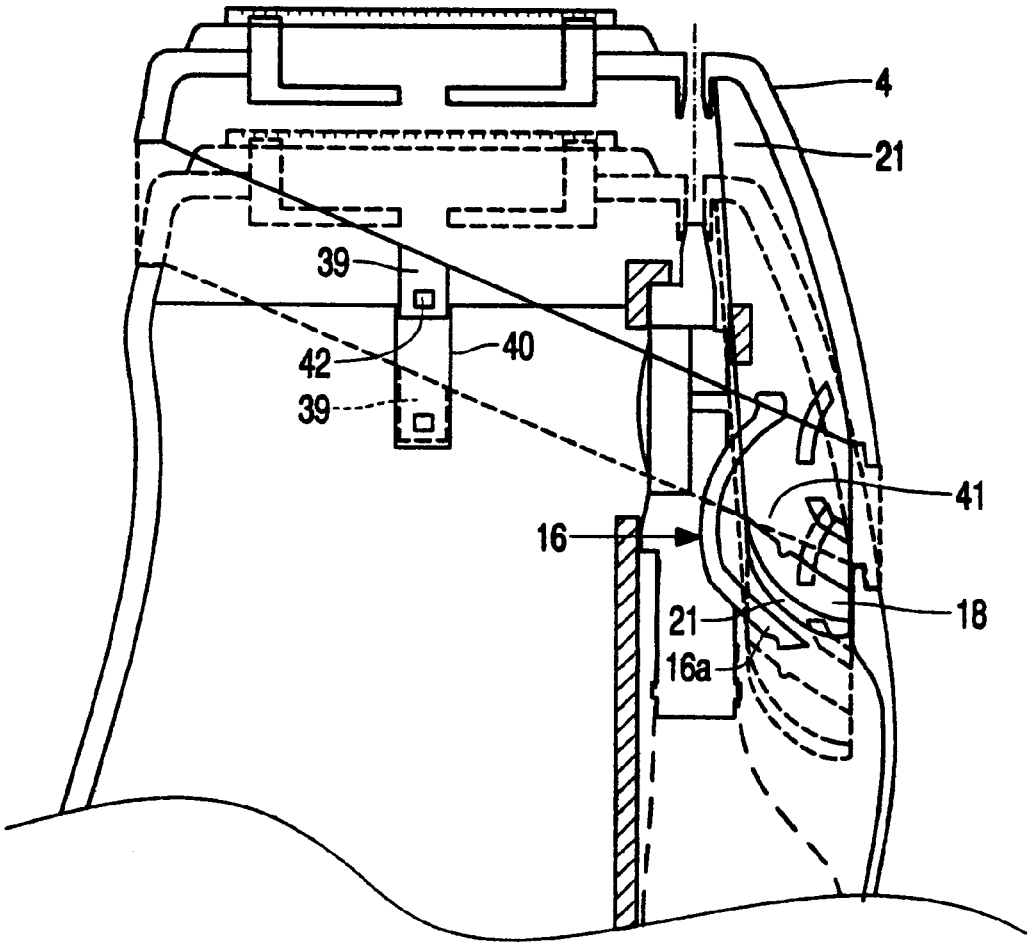
FIG. 7 is a diagrammatic cross-sectional view of the shaving apparatus, similar to that of FIG. 2, a detached shaving head being replaced on the housing.

FIG. 7 illustrates the situation when a removed holder is refitted. When the shaving head holder 4 has been removed completely from the housing, as has been described with reference to FIG. 4, the holder can be replaced onto the housing 1 in a simple manner. For this purpose, the holder has two downwardly projecting guide limbs 39 (see also FIG. 1). The housing has two corresponding recesses 40. When the holder 4 is placed with its supports 21 into the space 41 between the limb 16 and the housing wall the guide limbs 39 can be slid into the recesses 40. By pressing the holder practically straight downwards the guide projections 18 slide over the limb portion 16*a* and the holder resumes the position as shown in FIG. 2. By means of the guide limbs 39 it is also possible to realize a locking 42 of the holder 4 onto the housing.

What is claimed is:

1. A shaving apparatus having a housing (1) and a shaving head (2), a hair-collecting chamber (3) for collecting hair cuttings being situated between the housing and the shaving head, which shaving head has a holder (4) which holds at least one shaving unit (5) comprising an external cutting member (6) and a drivable internal cutting member (8) which cooperates with said external cutting member, which shaving apparatus has a drive unit (10) including a drive member (11) having a longitudinal direction (14), which internal cutting member has been provided with a coupling element (13) adapted to be coupled to the drive member (11), and which holder (4) is connected to the housing (1) by means of a hinge construction (15), characterized in that the hinge construction (15) is such that during opening of the hair-collecting chamber (3), in a first stage (D1), the holder (4) performs a pivotal movement with a large radius (R1) of curvature about a first center (M1) which is situated outside of the housing (1) and substantially in a coupling plane (50) through the coupling element (13) which is parallel to a shaving plane (60) through the shaving head (2).

2. A shaving apparatus as claimed in claim 1, characterized in that, for opening the hair-collecting chamber (3), the holder (4) performs a pivotal movement with a smaller radius of curvature (R2) with respect to the housing (1) in a second stage (D2) following the first stage (D1).

3. A shaving apparatus as claimed in claim 2, characterized in that locking means have been provided, for locking the holder (4) against pivotal movement at the end of the second stage (D2).

4. A shaving apparatus as claimed in claim 2, characterized in that for removing the holder (4) from the housing (1) the holder performs a further pivotal movement in a third stage following the second stage, in which third stage the holder is unlocked from the housing.

5. A shaving apparatus as claimed in claim 2, characterized in that the hinge construction (15) has an accurate limb (16) and an accurate guide (17) which cooperates with said limb, which limb has a first limb portion (16*a*) having a comparatively large radius of curvature (R1) and, adjoining the first limb portion (16*a*), a second limb portion (16*b*) having a comparatively small radius of curvature (R2), and which guide (17) is formed by walls (18*a*, 19*a*, 19*b*, 20*a*) of guide projections (18, 19, 20), at least a first one of said walls (18*a*, 19*a*) having a comparatively large radius of curvature for cooperation with the first limb portion (16*a*) and at least a second one of said walls (19*b*, 20*a*) having a comparatively small radius of curvature for cooperation with the second limb portion (16*b*).

6. A shaving apparatus as claimed in claim 5, characterized in that locking means have been provided for locking the holder (4) against pivotal movement at the end of the second stage (D2) and in that the locking means are formed by a projecting portion (22) at the free end of the second limb portion (16*b*) and, cooperating therewith, a recess (23) of one of the guide projections (18).

7. A shaving apparatus as claimed in claim 5, characterized in that two identical hinge constructions (15) have been provided, which hinge constructions are spaced at a distance from one another and are arranged symmetrically with respect to one another, the holder (4) having two supports (21) which are spaced at said distance from one another and which each carry the arcuate guide (17) comprising the guide projections (18, 19, 20).

8. A shaving apparatus as claimed in claim 5, characterized in that the holder (4) has been provided with two guide limbs (39) which are disposed opposite one another for cooperation with corresponding recesses (40) of the housing (1).

9. A shaving apparatus as claimed in claim 1, characterized in that the housing has a chamber (25) adapted to hold an additive container (26), which container has an outlet (29) for an additive (27), which shaving apparatus further comprises a pump (30) having an inlet (31), which can be connected to the outlet (29) of the additive container (26), and having an outlet opening (33), which holder (4) has a dispenser channel (34) having an inlet opening (35) to which the outlet opening (33) of the pump (30) can be connected and through which the additive (27) can be dispensed by means of the pump, the dispenser channel having a longitudinal direction (38) which is oriented parallel to the longitudinal direction (14) of the drive member (11).

* * * * *